US005511762A

United States Patent [19]

Connors, Jr. et al.

[11] Patent Number: 5,511,762

[45] Date of Patent: * Apr. 30, 1996

[54] CONSUMABLE FORM WITH DEGRADABLE LINING

[75] Inventors: Charles W. Connors, Jr., Chicago; James S. Irwin, Geneva, both of Ill.

[73] Assignee: Magneco/Metrel, Inc., Addison, Ill.

[ * ] Notice: The portion of the term of this patent subsequent to Nov. 15, 2013, has been disclaimed.

[21] Appl. No.: 156,563

[22] Filed: Nov. 22, 1993

Related U.S. Application Data

[63] Continuation-in-part of Ser. No. 153,266, Nov. 15, 1993, which is a continuation of Ser. No. 893,377, Jun. 4, 1992, abandoned, which is a continuation of Ser. No. 673,954, Mar. 22, 1991, abandoned.

[51] Int. Cl.[6] ..... B28B 7/34; B28B 7/36; F27D 1/16

[52] U.S. Cl. ..... 249/115; 249/62; 249/135; 249/144; 249/174; 264/30; 264/35; 264/36; 264/317; 264/338; 266/281

[58] Field of Search ..... 264/30, 31, 35, 264/36, 313, 316, 317, 319, 332, 333, 80, 334, 337, 338, 344, DIG. 44; 266/281, 196; 249/61, 62, 142, 144, 174, 115, 135

[56] References Cited

U.S. PATENT DOCUMENTS

| | | | |
|---|---|---|---|
| 640,653 | 1/1900 | Guy | 249/115 |
| 963,431 | 7/1910 | Gates | 249/115 |

(List continued on next page.)

FOREIGN PATENT DOCUMENTS

| | | |
|---|---|---|
| 116722 | 3/1943 | Australia . |
| 0064863 | 11/1982 | European Pat. Off. . |
| 505141 | 9/1992 | European Pat. Off. . |
| 2435532 | 2/1976 | Germany . |
| 2512841 | 9/1976 | Germany . |
| 2659205 | 7/1977 | Germany . |
| 44-9646 | 5/1969 | Japan . |
| 53-113808 | 10/1978 | Japan . |
| 57-72758 | 5/1982 | Japan . |
| 59-156969 | 9/1984 | Japan . |
| 60-96580 | 5/1985 | Japan . |

(List continued on next page.)

OTHER PUBLICATIONS

"Stay–Form" Spec–Data Sheet by Alabama Metal Industries Corp. (Feb., 1989).

Abstract of Japanese publication JP63154258, Patent Abstracts of Japan, vol. 012416, (M–759) published Apr. 11, 1988.

U.S. Patent Application Serial No. 08/153,266 filed Nov. 15, 1993 by Connors Jr.

*Primary Examiner*—Karen Aftergut

*Attorney, Agent, or Firm*—Willian Brinks Hofer Gilson & Lione

[57] ABSTRACT

A method of manufacturing an open top, walled member for containing a molten metal, including the steps of forming an inner wall of a mold with a metal sheet and an inner lining covering the sheet, wherein the inner wall defines an inside surface of the walled member and transferring a casting compound between an outer wall of the mold and the inner lining of the inner wall to form the walled member. The metal sheet and inner lining are then removed to allow one to apply heat to dry the casting compound. In the case where the metal sheet includes a plurality of openings, one may also retain the inner wall during the heating step. The heat to dry the casting compound is applied to the inner lining to a sufficient temperature to melt the inner lining and uncover said openings of the metal sheet. The metal sheet is removed when the casting compound is dried. Another aspect of the present invention is a mold for forming an open top, walled member for containing a molten metal having an inner wall including an inner lining and a metal sheet and an outer wall, wherein the inner wall and the outer wall are spaced relative to each other to define a space so that the open top, walled member is formed therebetween.

8 Claims, 1 Drawing Sheet

U.S. PATENT DOCUMENTS

| | | | |
|---|---|---|---|
| 1,552,064 | 9/1925 | Lake . | |
| 1,643,425 | 9/1927 | Summey . | |
| 1,656,312 | 1/1928 | Black . | |
| 1,678,976 | 7/1928 | Durfee . | |
| 1,710,931 | 4/1929 | Klein . | |
| 2,031,101 | 11/1942 | Welshans . | |
| 3,396,961 | 8/1968 | Farrington . | |
| 3,492,383 | 1/1970 | Heimgartner . | |
| 3,672,649 | 6/1972 | Allen . | |
| 3,703,348 | 11/1972 | Pivar . | |
| 3,885,016 | 5/1975 | Pivar . | |
| 3,916,047 | 10/1975 | Niesen . | |
| 4,049,759 | 9/1977 | Florian | 249/115 X |
| 4,078,292 | 3/1978 | Porter . | |
| 4,279,844 | 7/1981 | Danjyo et al. . | |
| 4,364,798 | 12/1982 | Costa . | |
| 4,438,906 | 3/1984 | English . | |
| 4,442,050 | 4/1984 | Takuo . | |
| 4,469,309 | 9/1984 | Takashima et al. . | |
| 4,480,820 | 11/1984 | Zhukov et al. . | |
| 4,919,388 | 4/1990 | Koike et al. | 249/115 |
| 4,957,270 | 9/1990 | Rummage et al. | 249/115 X |

FOREIGN PATENT DOCUMENTS

| | | |
|---|---|---|
| 60-137865 | 7/1985 | Japan . |
| 969453 | 10/1982 | U.S.S.R. . |
| 1415431 | 11/1975 | United Kingdom . |
| 1513210 | 6/1978 | United Kingdom . |
| 2105828 | 3/1983 | United Kingdom . |
| 85/02397 | 6/1985 | WIPO . |

CONSUMABLE FORM WITH DEGRADABLE LINING

This application is a continuation-in-part of application Ser. No. 08/153,266, filed Nov. 15, 1993, which is a continuation of application Ser. No. 07/893,377, filed Jun. 4, 1992, now abandoned, which was a continuation of application Ser. No. 07/673,954, filed Mar. 22, 1991, now abandoned.

BACKGROUND OF THE INVENTION

This invention relates to a method of and structure for manufacturing open top, walled members such as troughs, runners, ladles and other vessels which are used for containing and processing molten iron and steel. It is well known in the art that such open, top walled members may have sufficient structural integrity to support alone a molten metal poured therein.

Conventionally, troughs and runners for transporting molten iron and steel are constructed in situ near a tap spout of a blast furnace or other molten metal container. The mold for the trough or runner utilizes the existing walls of a trench or other existing structure as the outer (lower) walls of the mold. The inner (upper) walls of such molds have conventionally been formed of heavy steel plates spaced from the outer walls leaving only an open space between the outer and inner mold walls in which to pour the casting compound and to provide a venting area for the release of moisture during setting of the casting compound. In the past, heavy oil or grease was placed on the interior sides of the inner walls facing the outer walls to allow for more ease in the removal of the inner wall from the casting compound. However, when the inner walls were removed when the casting compound had sufficiently set, cracks and bubbles were formed resulting in a rough surface.

As mentioned in U.S. patent application Ser. No. 07/893,377, filed Jun. 4, 1992, and later abandoned in favor of filing a File-Wrapper Continuation on Nov. 15, 1993 and accorded U.S. patent application Ser. No. 08/153,266 still pending, whose entire contents are incorporated herein by reference, the prior art inner mold walls made of heavy steel plates can be replaced with a consumable inner wall made of an open mesh, galvanized steel screen. The use of the open mesh screen as the inner walls of the mold permits the drying process for the casting compound to be started as soon as the pouring process ends. It is not necessary to wait for the casting compound to set because the mesh screen is not removed during the drying process. There are adequate openings in the mesh screen to permit venting of moisture from the drying compound and, in fact, the mesh screen is not removed until it is melted by the molten metal being introduced into the finished trough or runner. Also, since the mesh screen is lightweight and the casting compound is of a consistency that it can be pumped into the mold cavity, cranes and hoppers are not needed in the construction of the troughs and runners, thereby reducing the cost of such an installation.

In some instances it is desired to use the mesh screen a multiple number of times for the formation of other troughs or runners. This provides a savings in cost by preserving the screen material. Manufacturing time is reduced by forming a multiple number of identical troughs or runners from a single mesh screen instead of creating a mesh screen for each trough or runner. This also provides a consistency in the quality of each trough or runner. In addition, it is sometimes desired to prevent the cold iron or steel of the screen from being dissolved into the molten metal when poured into the trough or runner since it results in a decrease in the temperature of the molten metal which decreases flow characteristics of the molten metal.

To use the mesh screen multiple times and to avoid dissolving the screen, it is necessary to remove the screen prior to the curing process to avoid the melting of the screen once the molten metal is poured into the trough or runner. As with the prior art steel plated inner walls, one would use heavy oil or grease to remove the screen from the casting compound thus causing cracking and bubbles and a rough surface.

Accordingly, it is an object of the present invention to provide a method and structure for forming a walled member having smoother surfaces with increased resistance to erosion.

It is another object of the present invention to provide a method of repairing walled members to provide a smooth surface with increased resistance to erosion.

It is another object of the present invention to provide a mold for forming a walled member which is easier to remove from the castable compound before the drying and curing process is begun.

It is another object of the present invention to provide a consumable mold having a structure to allow for forming a smoother surface and providing improved drying and curing of the castable compound.

SUMMARY OF THE INVENTION

One or more of the above-mentioned objects along with other objects of the invention are accomplished by the method of manufacturing an open top, walled member for containing a molten metal, comprising the steps of forming an inner wall of a mold with a metal sheet and an inner lining covering the sheet, wherein the inner wall defines an inside surface of the walled member and transferring a casting compound between an outer wall of the mold and the inner lining of the inner wall to form the walled member. The metal sheet and inner lining are then removed to allow one to apply heat to dry the casting compound.

The above-mentioned method provides the advantages of producing a smoother surface and allows one to use the inner wall to form other walled members having the same shape.

In the case where the metal sheet comprises a plurality of openings, one may also retain the inner wall during the heating step. The heat to dry the casting compound is applied to the inner lining to a sufficient temperature to melt the inner lining and uncover said openings of said metal sheet. As mentioned in U.S. patent application Ser. No. 07/893,377, the number of openings are chosen so that the drying and curing process is accelerated. The metal sheet is removed when the casting compound is dried.

Another aspect of the present invention is a mold for forming an open top, walled member for containing a molten metal having an inner wall comprising an inner lining and a metal sheet and an outer wall, wherein the inner wall and the outer wall are spaced relative to each other to define a space so that said open top, walled member is formed therebetween.

BRIEF DESCRIPTION OF THE DRAWINGS

The invention is illustrated more or less diagrammatically in the following drawings wherein.

DESCRIPTION OF THE PREFERRED EMBODIMENTS

Figure 1:
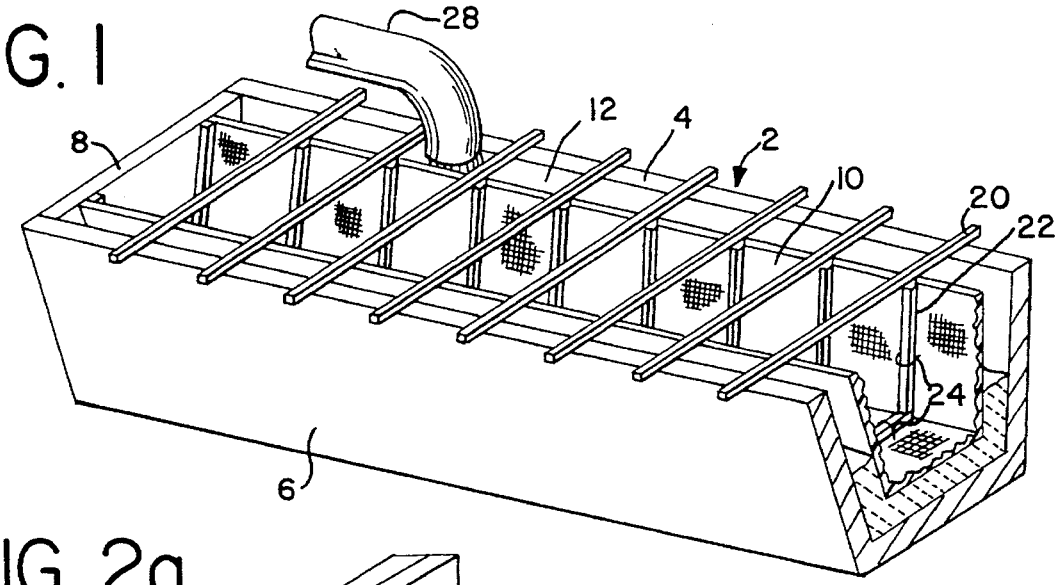
FIG. 1 is a partial perspective view showing the method and structure in which a casting compound is pumped into a trough mold with the inner walls of the mold having an inner lining.

FIGS. 1–4 of the drawings show a method of manufacture of an open top, walled structure such as a trough or runner 2 which is used as a containment member to transfer molten metal, such as iron and steel, from a source of molten metal such as the tap hole of a blast furnace or converter.

The trough is formed by a mold 4. The outer (lower) wall 6 of mold 4 may be an in situ formation such as a concrete, stone or brick trench. The end wall 8 of the trough 2 is also an in situ structure and may be the wall of a blast furnace or other molten metal-containing source. The inner (upper) wall 10 of mold 4 is positioned within outer wall 6 such that a void space 12 is defined between inner wall 10 and outer wall 6.

Figure 2A:
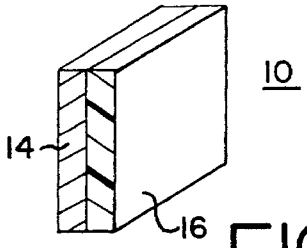
FIG. 2*a* is a cross-sectional view of an inner wall of a mold to be used in FIG. 1 having a screen mesh and an inner lining.
Figure 2B:
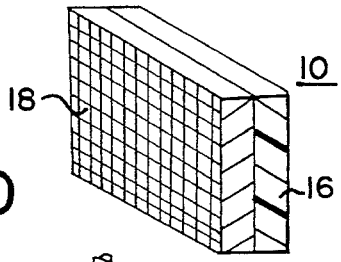
FIG. 2*b* is a cross-sectional view of an inner wall of a mold to be used in FIG. 1 having a plate and an inner lining.

As seen in FIGS. 2*a* and 2*b*, the inner walls 10 of the mold 4 are formed of a metal sheet 14 and an inner lining 16 covering the metal sheet 14. In the embodiment of FIG. 2*a*, the metal sheet 14 is solid having no openings and made of ¼ inch thick steel. Attached to an entire side of metal sheet 14 facing the outer wall 6 is an inner lining 16. Inner lining 16 is made of a flexible material, such as (1) Poly-Shrink material made by the Rapit-Pac company of St. Charles, Ill., (2) shrink wrap plastic, (3) paper, or (4) cloth, which when attached to the metal sheet 14 defines a smooth surface. The thickness of the inner lining 16 ranges from 0.6 mm–1.0 mm for shrink wrap plastic, 0.6 mm–1.0 mm for paper, and 0.6 mm–1.0 mm for cloth. Attachment of the flexible material to metal sheet 14 is accomplished by heat, strapping, or wire ties. The above-described inner wall may be positioned above outer wall 6 by a crane (not shown) in a manner well known in the art. It is understood that lining 16 may be made of one or more separate pieces having various shapes so as to cover the entire side of sheet 14.

As shown in FIG. 2*b*, another embodiment of inner wall 10 comprises an open mesh, galvanized steel screen 18 having a plurality of openings and an inner lining 16. The screen is obtained by lancing and expanding galvanized sheet steel to form solid V-shaped ribs with expanding mesh portion with the mesh openings being in the shape of parallelograms. A screen of this type is sold by Alabama Metal Industries Corp. of Birmingham, Ala. under the name "Stay-Form". Of course, other screens with similar characteristics may also be used. Screens of this type have been conventionally used as leave-in-place mold walls for concrete building construction with the screens functioning as permanent parts of the hardened concrete walls. As with the embodiment of FIG. 2*a*, inner lining 16 comprises a flexible material, such as Poly-Shrink material, shrink wrap plastic, paper, or cloth, that is attached to the screen 18 so as to cover the entire screen and to face the outer wall 6. Attachment is accomplished by heat, strapping, or wire ties. It is understood that lining 16 may be made of one or more separate pieces having various shapes so as to cover all of the openings of a side of screen 18.

As seen in FIG. 1, in order to hold the inner wall 10 of FIG. 2*b* in place during the pouring of the casting compound, a framework 20 consisting of rectangular tubes 22 made of steel or Re-Bar connected together by wire ties 24 is supported on the outer wall 6 of the mold 4.

In both of the embodiments of FIGS. 2*a–b*, once the inner wall 10 is positioned over outer wall 6, a casting compound 26 is pumped and transferred into the void space 12 between the inner lining 16 and the outer wall 6 of the mold 4 through a flexible tube 28. The casting compound preferably is an alumina-silicon carbide refractory of the type described in U.S. patent application Ser. No. 07/527,033, filed May 21, 1990, and abandoned in favor of Ser. No. 07/798,347, filed Nov. 21, 1991, which then issued on Sep. 15, 1992 as U.S. Pat. No. 5,147,830, and assigned to the same assignee as this patent application, since the need for cranes and hoppers to transport the casting compound to the molds and the steel plates which make up the conventional inner walls of the molds are eliminated. The entire disclosure of said patent application is incorporated herein by reference.

The preferred casting composition preferably includes, as a major component, a refractory base material in an amount of between 55–90% by weight. The refractory base material preferably has an average particle diameter of between 30 micrometers and 7 millimeters and preferably is composed of calcined clay, mullite, brown fused alumina, tabular alumina or mixtures thereof. When calcined clay or mullite is utilized, the amount is preferably between 60–75% by weight. When brown fused alumina is used, the amount is preferably between 65–80% by weight. For tabular alumina, the amount is preferably between 70–90% by weight.

In addition to the refractory material, the casting composition preferably includes silicon carbide in an amount of between 1–35% by weight, and more preferably in an amount of between 5–25% by weight. The silicon carbide preferably has an average diameter of between 30 micrometers and 1.5 millimeters.

The casting composition may optionally include 2–10% by weight of graphite which ultimately acts as a nonwetting agent to prevent attachment to or penetration of the base material by slag. The graphite may be amorphous or crystalline or in the form of flakes.

The casting composition also includes a silica binder which is formed from finely dispersed (preferably colloidal) silica particles in an aqueous medium. Silica having an average diameter of preferably between 4–100 millimicrons, and most preferably 8–20 millimicrons, is initially dispersed in water in an amount of between 15–70% by weight, preferably about 40% by weight. The resulting colloidal silica binder is then mixed with the other components of the casting composition in an amount of between 8–14% based on the weight of the resulting composition.

The casting composition preferably includes between 0.02–1% of a setting agent. Examples of suitable setting agents are calcium aluminate cement and magnesium oxide. Finally, the casting composition preferably includes between 5–20% by weight of calcined alumina and between 1–10% by weight of microsilica.

The calcined alumina reacts with the silica binder to form a sediment phase which causes improved binding characteristics, particularly at higher temperatures. The calcined alumina preferably has an average diameter of 0.2–70 microns. The microsilica improves the initial flow characteristics of the casting composition. The microsilica preferably has an average diameter of 0.1–1.0 microns, and most preferably between 0.15–0.25 microns.

As the void space 12 between the outer wall 6 and inner lining 16 forming the inner walls of the mold 14 is filled with casting compound 26, a smooth outer surface resistant to erosion is formed adjacent the inner lining 16. In the embodiment of FIG. 2*a* wherein the inner wall 10 comprises a solid metal sheet, once the casting compound has sufficiently set the inner wall 10 is removed in a well known manner. The casting compound 26 is then dried and cured by applying heat in a well known manner to produce the trough or runner 2.

In the embodiment of FIG. 2*b*, where the inner wall 10 comprises a perforated screen 18, the inner wall 10 may be removed when the casting compound 26 has sufficiently set. The casting compound 26 is then dried and cured by applying heat to produce the trough or runner 2. By removing the inner wall 10 before the curing process, inner wall 10 can be used to manufacture another trough or runner 2 having the same shape.

Figure 3:
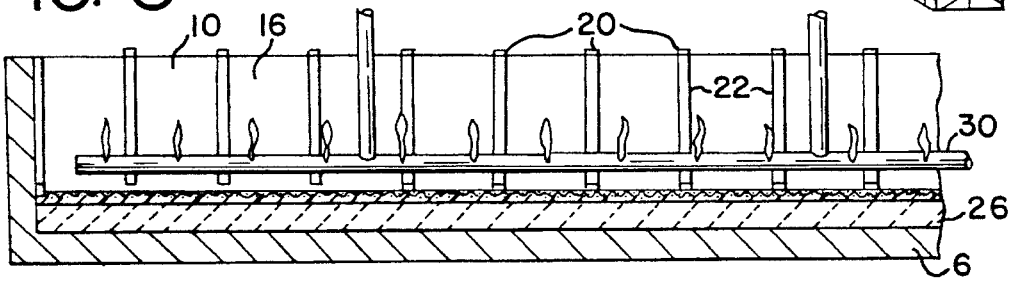
FIG. 3 is a longitudinal, cross-sectional view of the mold of FIG. 1 with the casting compound filling the space between the mold walls and heat being applied to the mold to dry the casting compound, wherein the inner wall of FIG. 2*a* or 2*b* is used.

The inner wall 10 of FIG. 2*b* may also be retained in position during the drying and curing of the casting compound. Drying and curing is accomplished by installing a temporary perforated gas pipe 30 running along the length of the mold 4 and igniting the gas, as shown in FIG. 3 of the drawings, to provide heat to dry the casting compound 26. The heat generated is an amount sufficient to raise the temperature of the inner lining 16 to melt the inner lining 16 and uncover the openings of the screen 18. The casting compound 26 can then be dried with the open mesh metal screen 18 which forms the inner walls 10 of the mold 4 remaining in place. The casting compound 26 is heated until the outer face or cold face of the casting compound reaches a temperature of 220° F.

The use of the open mesh screen 18 as the inner walls 10 of the mold 4 provides additional venting area for release of the moisture in the casting compound 26 than is provided in the conventional mold arrangement because the moisture can escape through the open mesh walls, not just through the open top of the mold. Accordingly, the buildup of bubbles and porosity in the dried casting compound at the top of the trough, which occurs in troughs formed by conventional casting methods, is reduced substantially or eliminated following the casting method of my invention. It should be noted that another variation of the inner wall is to place the flexible material only on the metal ribs of the screen while leaving the openings of the screen unobstructed. This generates a smoother surface and provides accelerated drying of the casting compound as well.

After the casting compound has been dried and cured, the screen 18 may be removed so that it can be layered with another inner lining 16 for forming another runner or trough 2.

Figure 4:
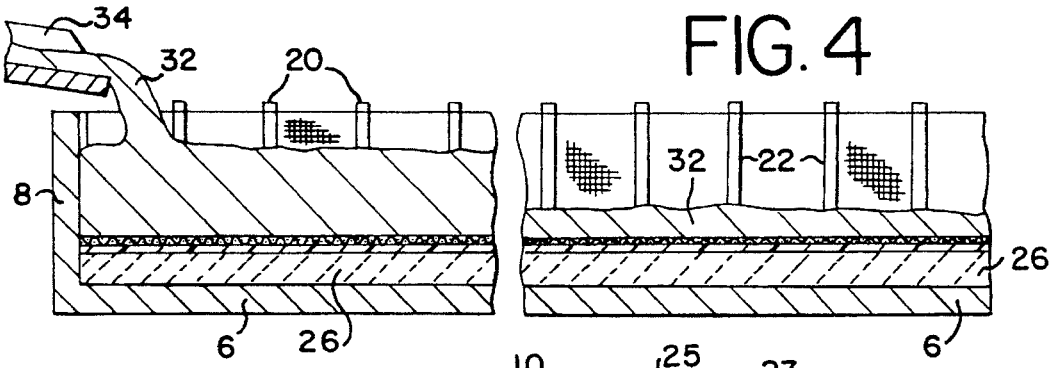
FIG. 4 is a broken, longitudinal, cross-sectional view of molten metal being poured into the finished trough with the molten metal melting the wire mesh of the inner walls of the mold and its supporting framework.

As shown in FIG. 4 of the drawings, in some instances it is not necessary to remove the open mesh metal screen 18 or its supporting framework 20 of rectangular steel or Re-Bar tubing 22, even after the casting compound 26 has been completely dried. The molten metal, which may be iron or steel 32, may be poured from a tap hole of a furnace through a spout 34 which dumps the molten metal into the trough 2 and melts away both the open mesh metal screen 18 and the supporting framework 20.

Figure 5:
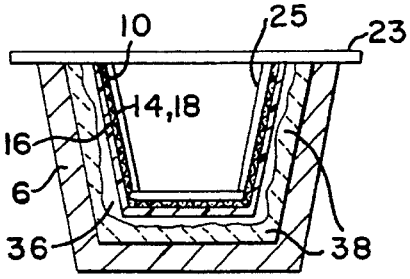
FIG. 5 is a lateral cross-sectional view of a trough showing the application of the method of the invention to the repair of a worn trough.

The present invention is also adaptable to repair and reconstruct worn troughs, runners, ladles and other vessels used for containing and processing molten metals, such as iron and steel. The repair of such a damaged or worn trough 2 would be accomplished in the manner shown in FIG. 5 of the drawings. All broken or damaged portions of the casting compound 26 forming the walls of the trough are removed. Inner mold walls 10 as described with respect to FIGS. 2*a–b*, are positioned over the damaged portion to define a space or void. A casting compound 26 is poured or pumped into the space 36 between the inner lining 16 of the inner wall 10 and the old casting compound 38 still remaining to form a rebuilt wall. The inner wall may be supported by a crane in the embodiment of FIG. 2*a* or supported by a framework 23 of rectangular steel tubing 25 as shown in FIG. 5.

While the embodiments of the invention disclosed herein are presently considered to be preferred, it is understood that various modifications and improvements can be made without departing from the spirit and scope of the invention. For example, it is understood that the present invention encompasses other molten containment vessels for molten iron, steel, aluminum, or copper such as troughs, iron runners, slag runners, tundishes, steel ladles, torpedo ladles, iron transfer ladles, slag pots, tilting runner stoves, stacks, and tilting ladles. The scope of the invention is indicated in the appended claims and all changes which come within the meaning and range of equivalence of the claims are intended to be embraced therein.

We claim:

1. A mold for forming an open top, walled member having side walls and a bottom surface of a molten metal containment vessel, which walled member has sufficient structural integrity to support a molten metal poured in said member, comprising:

an inner wall comprising an inner lining entirely covering an inner surface of a perforated sheet metal screen having a plurality of openings therein and comprising inner side walls and an inner bottom surface for shaping inner surfaces of said side walls and said bottom surface of said open top, walled member; and an outer wall defining a volume of space substantially containing said inner wall, wherein said inner wall and said outer wall are spaced a sufficient distance relative to each other to define a space so that said side walls and said bottom surface of said open top, walled member of said molten metal containment vessel are formed therebetween, said walled member so formed having said sufficient structural integrity to support a molten metal poured in said member.

2. The mold of claim 1, wherein said inner lining comprises a plastic sheet.

3. The mold of claim 1, wherein said inner lining comprises a paper sheet.

4. The mold of claim 1, wherein said inner lining comprises a fabric sheet.

5. The mold of claim 1, wherein said outer wall comprises an in situ formation.

6. The mold of claim 1, wherein said outer wall comprises concrete.

7. The mold of claim 1, wherein said outer wall comprises stone.

8. The mold of claim 1, wherein said outer wall comprises brick.

* * * * *

UNITED STATES PATENT AND TRADEMARK OFFICE

CERTIFICATE OF CORRECTION

PATENT NO. : 5,511,762

DATED : April 30, 1996

INVENTOR(S) : Charles W. Connors, Jr.

It is certified that error appears in the above-indentified patent and that said Letters Patent is hereby corrected as shown below:

On the Title Page

On Page 2, in the first column under "U.S. PATENT DOCUMENTS", line 6, please delete "2,031,101" and substitute --2,301,101--.

Signed and Sealed this

Twenty-ninth Day of July, 1997

Bruce Lehman

*Attest:*

BRUCE LEHMAN

*Attesting Officer*

*Commissioner of Patents and Trademarks*